US009994351B2

(12) United States Patent
Lane

(10) Patent No.: US 9,994,351 B2
(45) Date of Patent: Jun. 12, 2018

(54) CONTAINER WITH FOLDED SIDEWALL

(71) Applicant: AMCOR LIMITED, Hawthorn, Victoria (AU)

(72) Inventor: Michael T. Lane, Brooklyn, MI (US)

(73) Assignee: Amcor Group GmbH, Zurich (CH)

( * ) Notice: Subject to any disclaimer, the term of this patent is extended or adjusted under 35 U.S.C. 154(b) by 0 days. days.

(21) Appl. No.: 15/505,499

(22) PCT Filed: Aug. 21, 2014

(86) PCT No.: PCT/US2014/052148

§ 371 (c)(1),
(2) Date: Feb. 21, 2017

(87) PCT Pub. No.: WO2016/028302

PCT Pub. Date: Feb. 25, 2016

(65) Prior Publication Data

US 2017/0267394 A1 Sep. 21, 2017

(51) Int. Cl.

| | |
|---|---|
| ***B65D 1/44*** | (2006.01) |
| ***B65D 1/02*** | (2006.01) |
| ***B65D 79/00*** | (2006.01) |

(52) U.S. Cl.

CPC ..... *B65D 1/44* (2013.01); *B65D 1/0246* (2013.01); *B65D 1/0276* (2013.01); *B65D 79/005* (2013.01)

(58) Field of Classification Search

CPC ... B65D 1/44; B65D 1/42; B65D 1/40; B65D 1/0276; B65D 1/0261; B65D 1/0246; B65D 1/023; B65D 1/0223; B65D 79/005

USPC ..... 215/373, 372, 371, 44, 43, 382, 381; 220/670, 675, 669, 609, 608, 604, 624, 220/623, 610, 689; D9/520, 516

See application file for complete search history.

(56) References Cited

U.S. PATENT DOCUMENTS

| | | | | |
|---|---|---|---|---|
| 2,339,763 A * | 1/1944 | Calleson | B65D 7/00 | 220/604 |
| 3,870,181 A * | 3/1975 | Sincock | B29C 49/12 | 215/373 |
| 4,082,200 A | 4/1978 | Guest et al. | | |
| 4,331,246 A * | 5/1982 | Sorensen | B65D 23/001 | 215/372 |
| 4,342,398 A * | 8/1982 | Chang | B65D 1/0276 | 215/373 |

(Continued)

FOREIGN PATENT DOCUMENTS

| | | |
|---|---|---|
| JP | 2000128140 A | 5/2000 |
| JP | 2013154907 A | 8/2013 |

OTHER PUBLICATIONS

International Search Report and Written Opinion of the ISA for PCT/US2014/052148, dated May 19, 2015; ISA/KR.

(Continued)

*Primary Examiner* — Robert J Hicks

(74) *Attorney, Agent, or Firm* — Harness, Dickey & Pierce, P.L.C.

(57) ABSTRACT

A blow-molded container including a finish and a base portion. The finish defines an opening at a first end of the container that provides access to an internal volume defined by the container. The base portion is at a second end of the container opposite to the first end. The base portion includes a fold proximate to a sidewall of the container.

24 Claims, 9 Drawing Sheets

(56) References Cited

U.S. PATENT DOCUMENTS

| | | | | |
|---|---|---|---|---|
| 4,836,398 | A * | 6/1989 | Leftault, Jr. | B65D 79/005 220/609 |
| 4,863,046 | A | 9/1989 | Collette et al. | |
| 6,299,007 | B1 | 10/2001 | Takeuchi | |
| 2005/0017013 | A1 | 1/2005 | Peisach et al. | |
| 2008/0047964 | A1 | 2/2008 | Denner et al. | |
| 2008/0257856 | A1 | 10/2008 | Melrose et al. | |
| 2011/0017700 | A1 | 1/2011 | Patcheak et al. | |
| 2012/0037645 | A1 * | 2/2012 | Boukobza | B65D 1/0276 220/600 |
| 2012/0181246 | A1 | 7/2012 | Ross et al. | |
| 2013/0001235 | A1 | 1/2013 | Patcheak et al. | |
| 2013/0087954 | A1 | 4/2013 | Tsuchiya | |
| 2013/0220968 | A1 * | 8/2013 | Imai | B65D 1/0261 215/371 |
| 2013/0240477 | A1 | 9/2013 | Saito et al. | |
| 2013/0248539 | A1 | 9/2013 | Schneider et al. | |
| 2014/0069937 | A1 | 3/2014 | Melrose et al. | |
| 2014/0109517 | A1 | 4/2014 | Melrose | |
| 2014/0123603 | A1 | 5/2014 | Denner et al. | |
| 2015/0008210 | A1 | 1/2015 | Oshino et al. | |

OTHER PUBLICATIONS

International Search Report and Written Opinion of the ISA for PCT/US2015/046110, dated Nov. 10, 2015; ISA/KR.
International Search Report and Written Opinion of the ISA for PCT/US2015/046123, dated Nov. 24, 2015; ISA/KR.
Extended European Search Report dated Feb. 19, 2018 in corresponding European Patent Application No. 149002677.

* cited by examiner

| | Side Load Causing Deformation at @ .250" (lbf) |
|---|---|
| 1) Existing Container | 15.38 |
| 2) Exemplary Container #1 | 21.97 |

CONTAINER WITH FOLDED SIDEWALL

CROSS REFERENCE TO RELATED APPLICATIONS

This application is a U.S. National Phase Application under 35 U.S.C. 371 of International Application No. PCT/US2014/052148 filed on Aug. 21, 2014 and published in English as WO 2016/028302 A1 on Feb. 25, 2016. The entire disclosure of the above application is incorporated herein by reference.

FIELD

The present disclosure relates to a container with a folded sidewall.

BACKGROUND

This section provides background information related to the present disclosure, which is not necessarily prior art.

As a result of environmental and other concerns, plastic containers, more specifically polyester and even more specifically polyethylene terephthalate (PET) containers, are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

While current containers are suitable for their intended use, they are subject to improvement. For example, a container having reduced weight and increased strength would be desirable.

SUMMARY

This section provides a general summary of the disclosure, and is not a comprehensive disclosure of its full scope or all of its features.

The present teachings provide for a blow-molded container having a base portion that effectively absorbs internal vacuum while maintaining basic shape, and resists deforming under top load. The finish defines an opening at a first end of the container that provides access to an internal volume defined by the container. The base portion is at a second end of the container opposite to the first end. The base portion includes a fold proximate to a sidewall of the container.

The present teachings further provide for a blow-molded container including a finish and a base portion. The finish defines an opening at a first end of the container that provides access to an internal volume defined by the container. The base portion is at a second end of the container opposite to the first end. The base portion includes a fold having an outer fold portion at a sidewall of the container, and an inner fold portion that is inward of the outer fold portion. The inner fold portion is closer to the first end than the outer fold portion is.

The present teachings provide for another blow-molded container including a finish and a base portion. The finish defines an opening at a first end of the container that provides access to an internal volume defined by the container. The base portion is at a second end of the container opposite to the first end. The base portion includes a fold, a diaphragm, and a connecting portion. The fold has an inner folded portion including a first curve and an outer folded portion at a sidewall of the container including a second curve. The inner folded portion is closer to the first end of the container than the outer folded portion. The outer folded portion may provide a post-fill standing surface of the container. The diaphragm extends between the fold and an axial center of the container. The diaphragm may provide a pre-filled standing surface of the container. The connecting portion is between the inner folded portion and the diaphragm, and includes a third curve.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
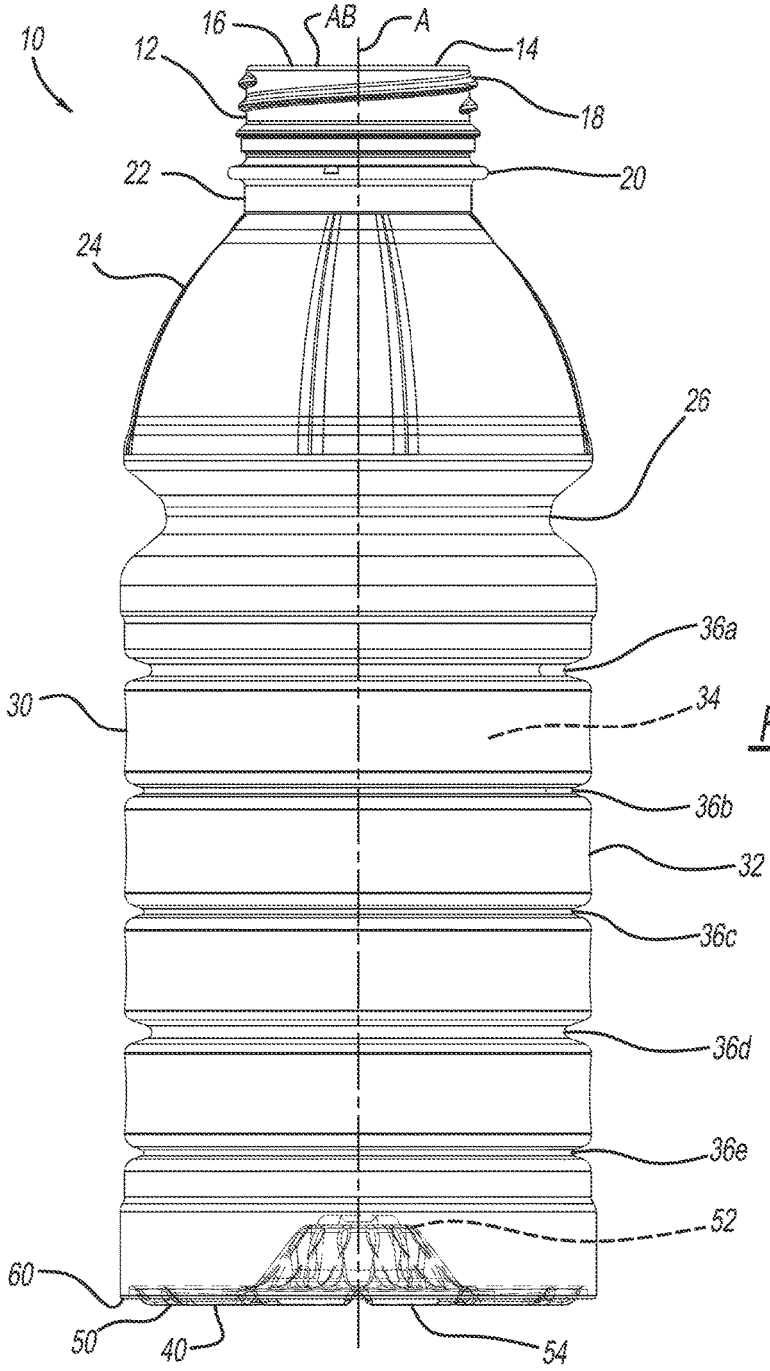
FIG. 1A is a side view of a container according to the present teachings in an as-blown, pre-filled configuration.
Figures 1B, 1C, 1D:
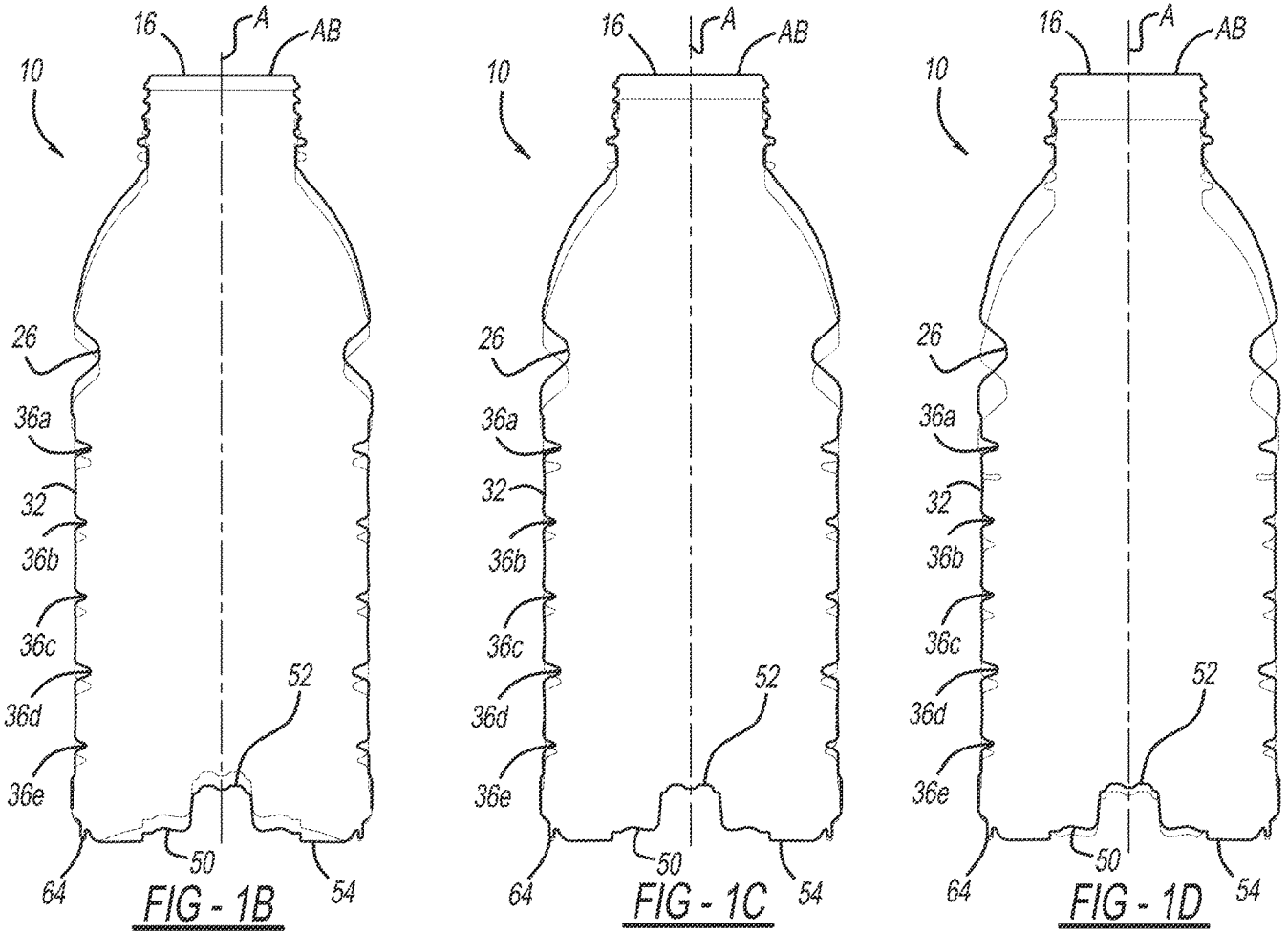
FIG. 1B is a side view of the container of FIG. 1A after the container has been hot-filled and has cooled.
FIG. 1C is a side view of the filled container of FIG. 1B subject to a top load pressure.
FIG. 1D is a side view of the container of FIG. 1C subject to further top load pressure.

With initial reference to FIG. 1A, a container according to the present teachings is generally illustrated at reference numeral 10. FIG. 1A illustrates the container 10 in an as-blown, pre-filled configuration. FIG. 1B illustrates the container 10 after being hot-filled and subsequently cooled, with the as-blown position shown at AB. FIG. 1C illustrates the container 10 subject to top load pressure, with the as-blown position shown at AB. FIG. 1D illustrates the container 10 subject to additional top load pressure, with the as-blown position shown at AB. FIGS. 1B-1D are described further herein.

As illustrated in FIG. 1A, the container 10 can be any suitable container for storing any suitable plurality of commodities, such as liquid beverages, food, or other hot-fill type materials. The container 10 can have any suitable shape or size, such as 20 ounces as illustrated. Any suitable material can be used to manufacture the container 10, such as a suitable blow-molded thermoplastic, including PET, LDPE, HDPE, PP, PS, and the like.

The container 10 generally includes a finish 12 defining an opening 14 at a first or upper end 16 of the container 10. The finish 12 includes threads 18 at an outer surface thereof, which are configured to cooperate with a suitable closure for closing the opening 14. In addition to, or in place of, the threads 18, any suitable feature for cooperating with a closure to close the opening 14 can be included. The threads 18 are between the opening 14 and a support ring 20 of the finish 12.

Extending from the support ring 20 on a side thereof opposite to the threads 18 is a neck portion 22. The neck portion 22 extends from the support ring 20 to a shoulder portion 24 of the container 10. The shoulder portion 24 tapers outward from the neck portion 22 in the direction of a main body portion 30. Between the shoulder portion 24 and the main body portion 30 is an inwardly tapered portion 26. The inwardly tapered portion 26 provides the container 10 with a reduced diameter portion, which can be the smallest diameter portion of the container 10 to increase the strength of the container 10.

The main body 30 extends to a second or lower end 40 of the container 10. The second or lower end 40 is at an end of the container 10 opposite to the first or upper end 16. A longitudinal axis A of the container 10 extends through an axial center of the container 10 between the first or upper end 16 and the second or lower end 40.

The main body portion 30 includes a sidewall 32, which extends to a base portion 50 of the container 10. The sidewall 32 defines an internal volume 34 of the container 10 at an interior surface thereof. The sidewall 32 may be tapered inward towards the longitudinal axis A at one or more areas of the sidewall 32 in order to define recesses or ribs 36 at an exterior surface of the sidewall 32. As illustrated, the sidewall 32 defines five recesses or ribs 36*a*-36*e*. However, any suitable number of recesses or ribs 36 can be defined, or there may be no ribs at all, providing a smooth container side wall. The ribs 36 can have any suitable external diameter, which may vary amongst the different ribs 36. For example and as illustrated, the first recess or rib 36*a* and the fourth recess or rib 36*d* can each have a diameter that is less than, and a height that is greater than, the second, third, and fifth recesses or ribs 36*b*, 36*c*, and 36*e*. In response to an internal vacuum, the ribs 36 can articulate about the sidewall 32 to arrive at a vacuum absorbed position, as illustrated in FIG. 1B for example. Thus, the ribs 36 can be vacuum ribs. The ribs 36 can also provide the container 10 with reinforcement features, thereby providing the container 10 with improved structural integrity and stability. The larger ribs 36*a* and 36*d* will have a greater vacuum response. Smaller ribs 36*b*, 36*c*, and 36*e* will provide the container with improved structural integrity.

The base portion 50 generally includes a central push-up portion 52 at an axial center thereof, through which the longitudinal axis A extends. The central push-up portion 52 can be sized to stack with closures of a neighboring container 10, and also be sized to modify and optimize movement of the base portion 50 under vacuum.

Figure 2A:
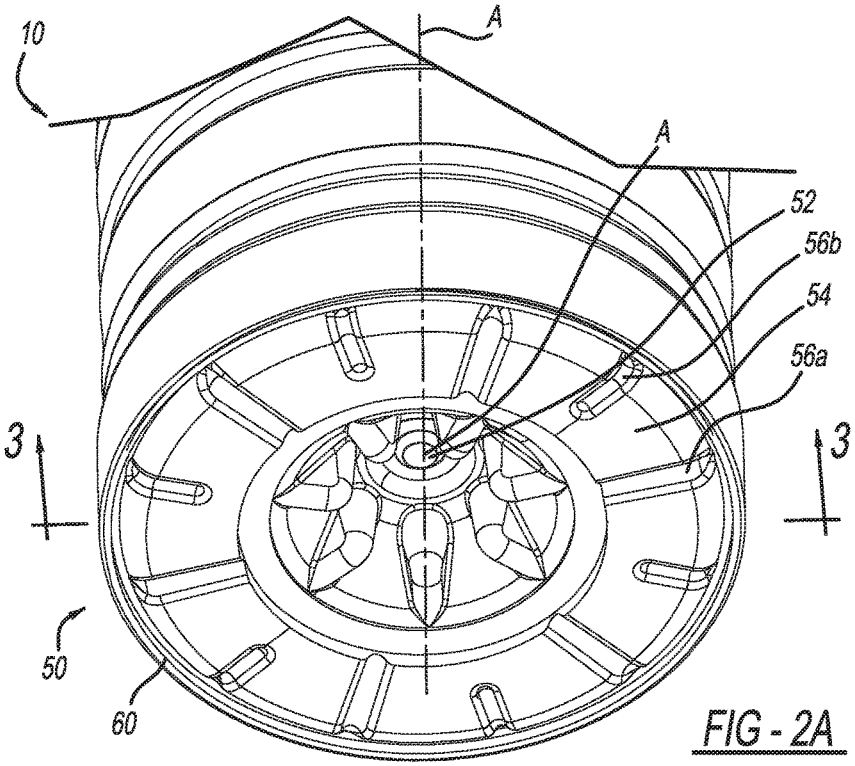
FIG. 2A is a perspective view of a base portion of the container of FIG. 1.
Figure 2B:
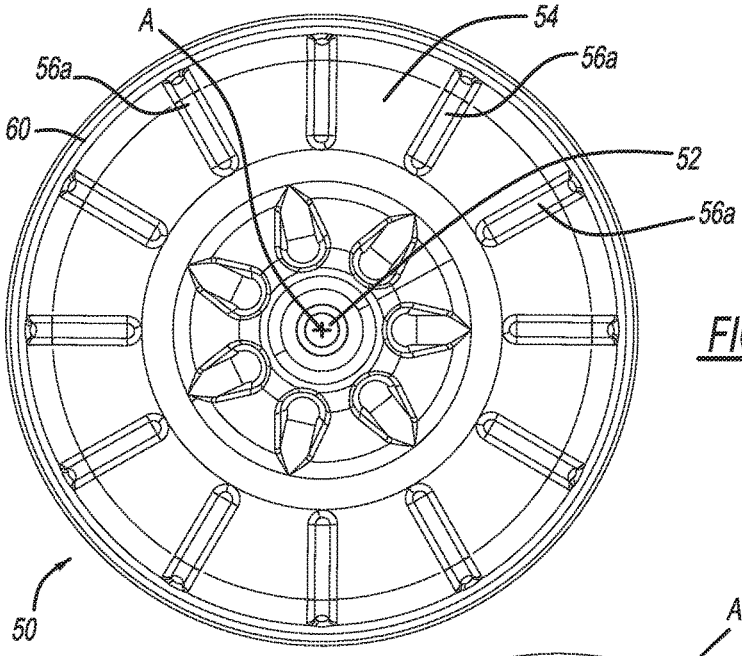
FIG. 2B is a planar view of a base portion of another container according to the present teachings.
Figure 2C:
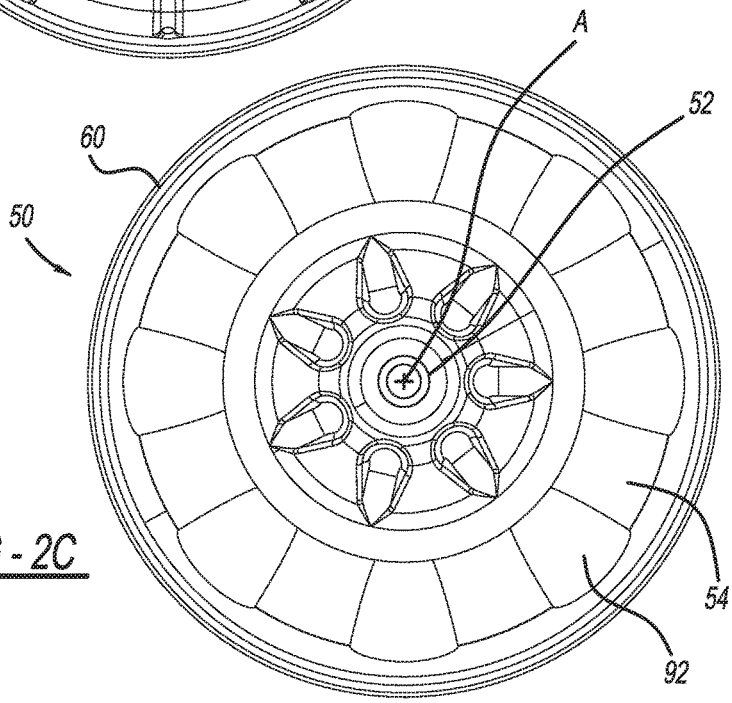
FIG. 2C is a planar view of a base portion of yet another container according to the present teachings.

Surrounding the central push-up portion 52 is a diaphragm 54. The diaphragm 54 can include any number of strengthening features defined therein. For example and as illustrated in FIG. 2A, a plurality of first outer ribs 56*a* and a plurality of second outer ribs 56*b* can be defined in the diaphragm 54. The first and second outer ribs 56*a* and 56*b* extend radially with respect to the longitudinal axis A. The first outer ribs 56*a* extend entirely across the diaphragm 54. The second outer ribs 56*b* extend across less than an entirety of the diaphragm 54, such as across an outermost portion of the diameter 54. The first and the second outer ribs 56*a* and 56*b* can have any other suitable shape or configuration. For example and as illustrated in FIG. 2B, the second outer ribs 56*b* can be replaced with additional first outer ribs 56*a*, which extend across the diaphragm 54. With reference to FIG. 2C, the first and second outer ribs 56*a* and 56*b* can be replaced with strengthening pads 92, which are spaced apart radially about the diaphragm 54. Any other suitable strengthening features can be included in the diaphragm 54, such as dimples, triangles, etc.

Figure 3:
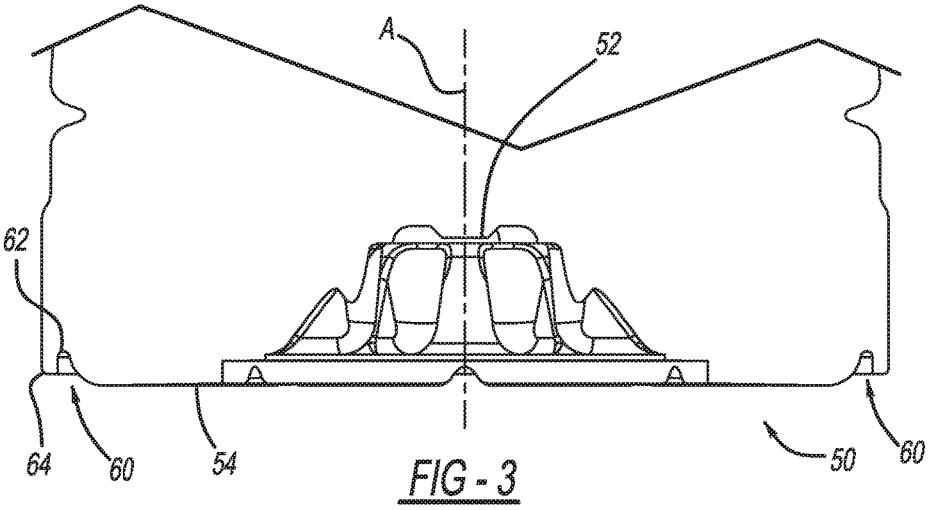
FIG. 3 is a cross-sectional view taken along line 3-3 of FIG. 2A.

The base portion 50 further includes a fold 60 at an outer diameter thereof. With continued reference to FIGS. 1A and 2A-2C, and additional reference to FIGS. 3, 4*a* (pre-fill, as-blown configuration), and 4*b* (post-fill configuration), the fold 60 generally includes a first or inner folded portion 62 and a second or outer folded portion 64. The inner folded portion 62 includes a first or inner curved portion 66. The outer folded portion 64 includes a second or outer curved portion 68. The inner curved portion 66 has a curve radius $R_1$ and the outer curved portion 68 has a curve radius $R_2$. The second or outer curved portion 68 extends to the sidewall 32. The outer folded portion 64, and specifically the outer curved portion 68 thereof, provide a heel of the base portion 50 and the container 10 as a whole.

Between the inner curved portion 66 and the outer curved portion 68 is an intermediate portion 70 of the fold 60. The intermediate portion 70 is generally linear, and generally extends parallel to the longitudinal axis A at least in the pre-fill configuration of the base portion 50 illustrated in FIG. 4A. The intermediate portion 70 also extends generally parallel to the sidewall 32.

Figure 4A:
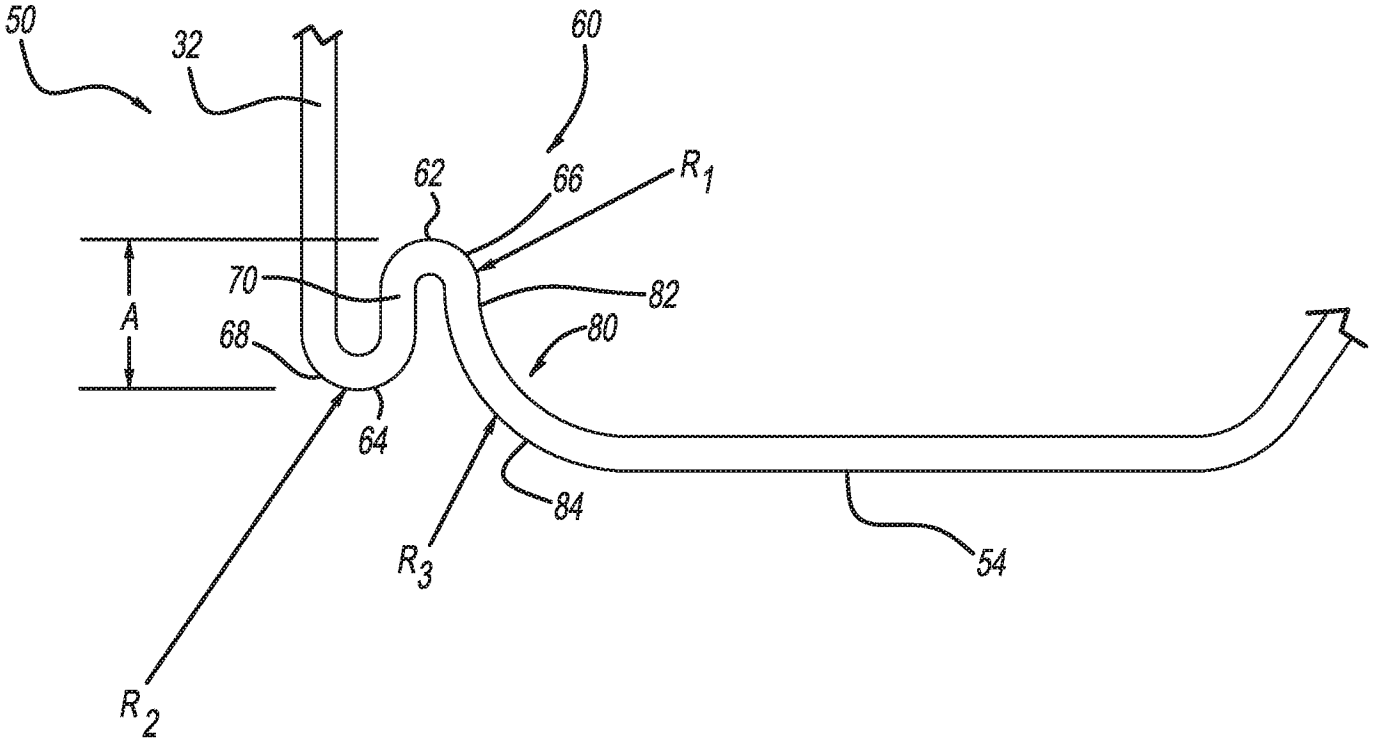
FIG. 4A is a schematic view of an area of the base portion of the container of FIG. 1 in a pre-fill configuration, the base portion including a fold.
Figure 4B:
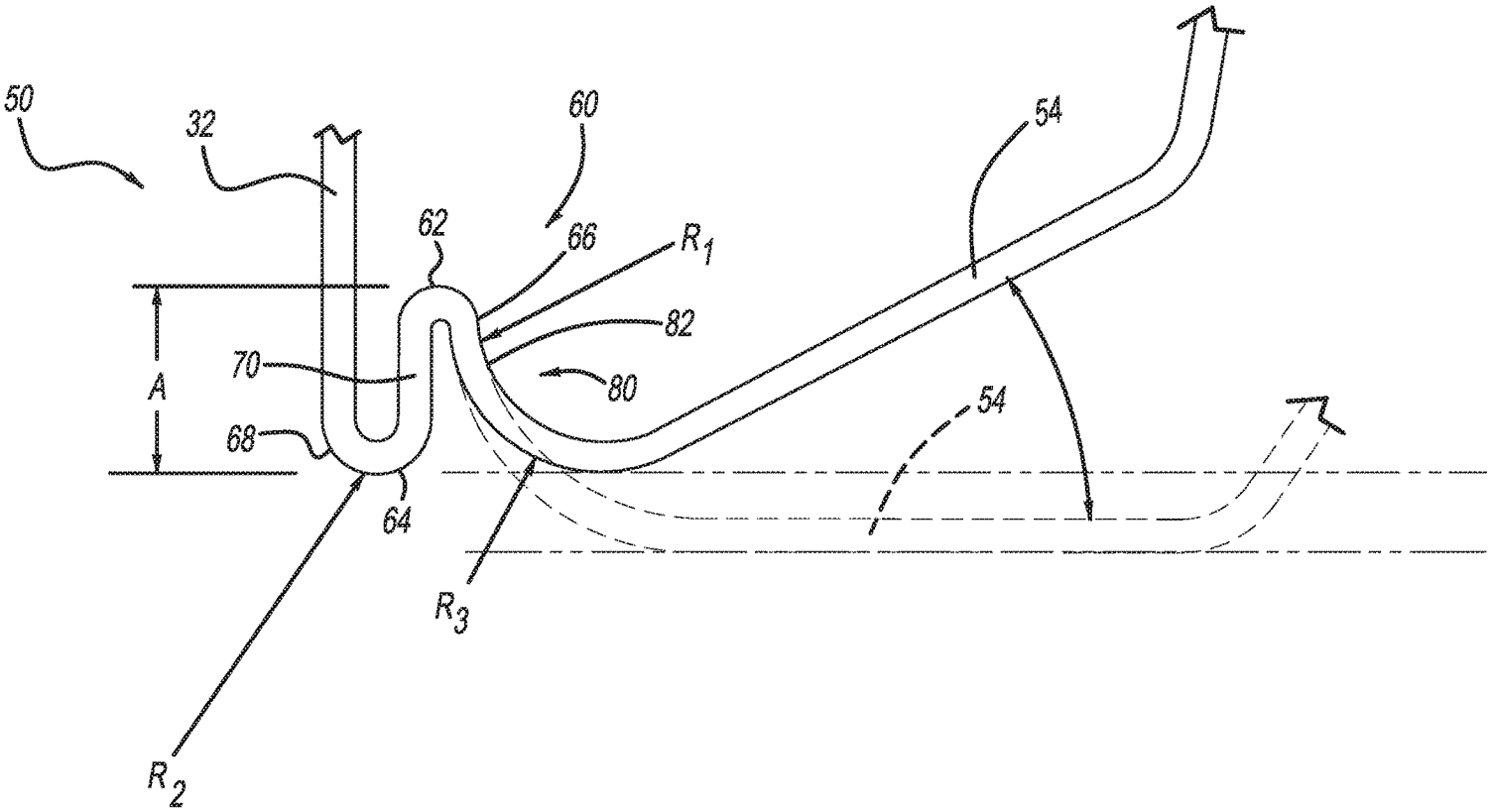
FIG. 4B is a schematic view of the area of the base portion of the container of FIG. 1 in a post-fill configuration.

A connecting portion 80 generally connects the inner folded portion 62 to the diaphragm 54. The connecting portion 80 includes a generally vertical portion 82 and a third curved portion 84. The generally vertical portion 82 extends from the inner folded portion 62 and specifically the inner curved portion 66 thereof. The generally vertical portion 82 extends generally parallel to the intermediate portion 70, the sidewall 32, and the longitudinal axis A of the container 10. In the pre-fill configuration of FIG. 4A, the vertical portion 82 is spaced apart from the intermediate portion 70. In the example of FIGS. 4A and 4B, the third curved portion 84 connects the vertical portion 82 to the diaphragm 54. The third curved portion 84 includes a curve radius $R_3$. The fold 60 is arranged inward from the sidewall 32 at any suitable distance from the sidewall 32, such as 1-3 millimeters from the sidewall. Specifically, and with reference to FIGS. 4A and 4B, for example, distance F between the vertical portion 82 of the connecting portion 80 and the sidewall 32 can be 1-3 millimeters.

In the pre-fill configuration of FIG. 4A, the diaphragm 54 provides a standing surface of the base portion 50 and the overall container 10. Thus the diaphragm 54 is at the second or lower end 40 of the container 10 and the outer folded portion 64 is arranged upward and spaced apart from the second or lower end 40. With additional reference to FIG. 4B, after the container 10 is filled, such as by way of a hot-fill process, vacuum forces within the container 10 cause the diaphragm 54 to retract and move towards the first or upper end 16 until the diaphragm 54 is generally coplanar with the outer folded portion 64 at $R_3$, or closer to the upper end 16 than the outer folded portion 64. Thus in the post-fill configuration of FIG. 4B, the standing surface of the base 50 includes both the diaphragm 54 and the outer folded portion 64, or only the outer folded portion 64.

In the pre-fill configuration of FIG. 4A, the container 10 is supported on the standing surface by the diaphragm 54 of the base portion 50. After hot-filling and capping, the base portion 50 responds to the increase in internal vacuum and reduction of internal volume due to the cooling of the filled contents. As illustrated in FIG. 4B for example, the diaphragm 54 pivots around three hinge radius points $R_1$, $R_2$, and $R_3$, and angles upwards into the container towards the first or upper end 16 from about zero degrees (0°) to about fifteen degrees (15°) at full activation, with a range of about ten degrees (10°) to twenty degrees (20°).

Hinge radius $R_1$ and hinge radius $R_2$ are about the same dimension, while the hinge radius $R_3$ is greater than $R_1$ and $R_2$. The primary hinge radius is $R_1$, which changes in dimension to accommodate the movement of the diaphragm 54 described above and illustrated in FIG. 4B. Radius $R_2$ and radius $R_3$ provide additional secondary dimensional change to adjust to the final shape of the base portion 50 under vacuum. Upon full activation, radius $R_3$ moves to about the same plane as radius $R_2$, and radius $R_2$ becomes the primary standing surface, as illustrated in FIG. 4B for example. When a top load force is applied, the angle of the diaphragm 54 is urged back to 0°, and radii points $R_1$, $R_2$, and $R_3$ adjust to compensate for the movement of the diaphragm 54. Under top load, the diaphragm 54 and radius $R_3$ are about level with, or parallel to, the radius $R_2$. The diaphragm 54, the radius $R_2$, and the radius $R_3$ are all generally level with, or parallel to, the standing surface and are constrained by the standing surface.

The combination of vacuum base portion 50 and the horizontal ribs 36 allows the container 10 to reach a state of hydraulic charge up when a top load force is applied after the container 10 is filled, as illustrated in FIGS. 1C and 1D for example, which allows the container 10 to maintain its basic shape. This movement of the base portion 50 caused by top load force is constrained by the standing surface, and the horizontal ribs 36 begin to collapse, thereby causing filled internal fluid to approach an incompressible state. At this point the internal fluid resists further compression and the container 10 behaves similar to a hydraulic cylinder, while maintaining the basic shape of the container 10.

Figures 6, 7:
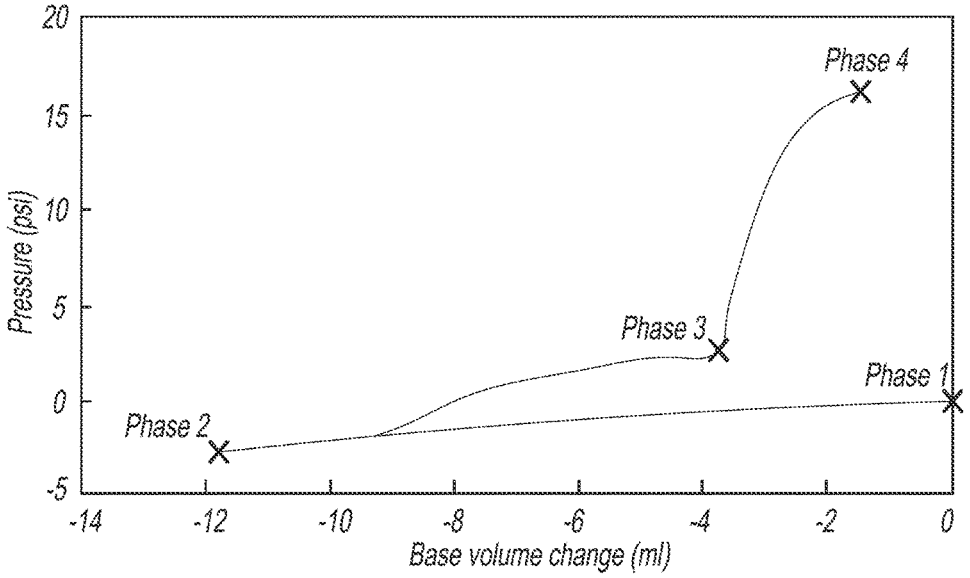
FIG. 6 is a chart illustrating exemplary characteristics of containers according to the present teachings.
FIG. 7 is a graph illustrating volume change versus pressure of an exemplary container according to the present teachings.
Figure 8:
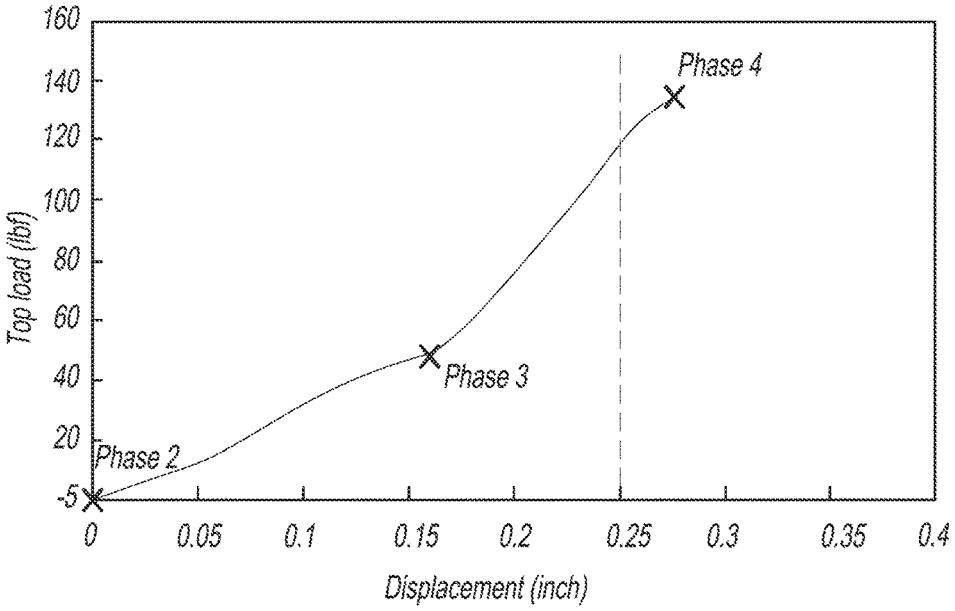
FIG. 8 is a graph of filled, capped, and cooled top load versus displacement of an exemplary container according to the present teachings.

More specifically, in the as-blown, prefilled configuration AB of FIG. 1A, the container 10 stands upright while resting on the diaphragm 54, and volume and pressure are zero or generally zero, thereby providing the container 10 in phase 1. FIG. 7 is a graph of volume change versus pressure, and FIG. 8 is a graph of filled, capped, and cooled top load versus displacement of an exemplary container 10 according to the present teachings. The various phases described herein are illustrated in FIGS. 7 and 8.

With reference to FIG. 1B, after the container is hot-filled and cooled, the base portion 50 is pulled up towards the upper end 16 due to internal vacuum. Overall height of the container 10 is reduced (compare the container 10 in the as-blown position AB), and the container 10 is supported upright at its outer folded portion 64, which is at radius $R_2$, to provide the container 10 at phase 2. With reference to FIG. 1C, application of top load urges the base portion 50 to the original as-blown position of FIG. 1A, and the internal vacuum crosses over to positive internal pressure, thereby providing phase 3. FIG. 1D illustrates phase 4 and an increase in top load, which returns the base portion 50 substantially to the original as-blown position of FIG. 1A and phase 1. The base portion 50 is constrained by the standing surface, the ribs 36 collapse causing further reduction in internal volume of the container 10, and a hydraulic spike in internal pressure advantageously facilitates very high top load capability.

Figure 5A:
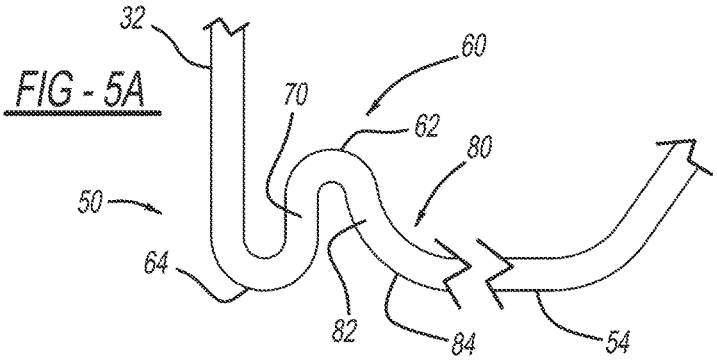
FIG. 5A is a schematic view of another container base portion according to the present teachings illustrating the base portion in a pre-fill configuration.
Figure 5B:
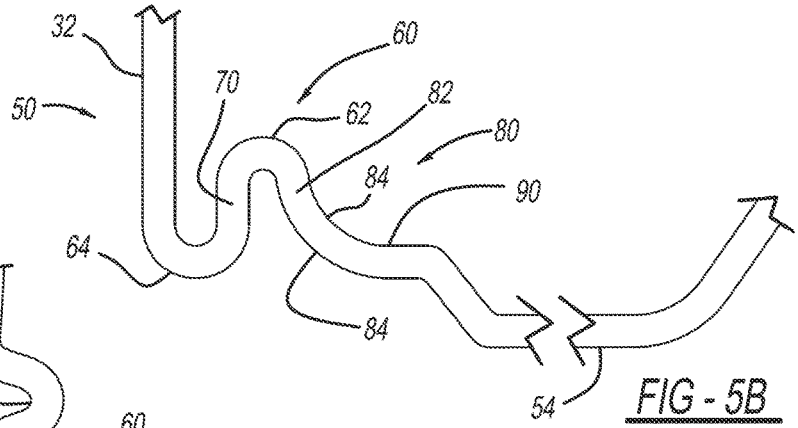
FIG. 5B is a schematic view of an additional container base portion according to the present teachings illustrating the base portion in a pre-fill configuration.
Figure 5C:
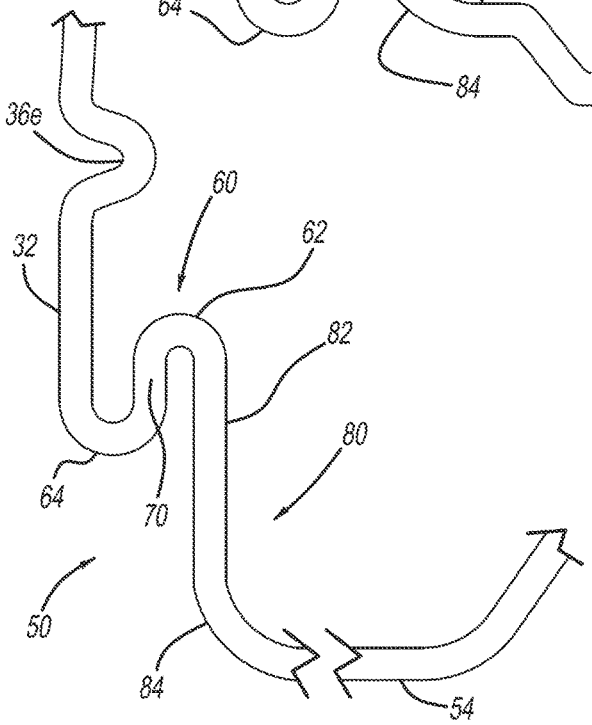
FIG. 5C is a schematic view of still another container base portion according to the present teachings illustrating the base portion in a pre-fill configuration.

With additional reference to FIGS. 5A-5C, additional exemplary configurations of the base portion 50 are illustrated. With initial reference to FIG. 5A, the base portion 50 is illustrated in the as blown, pre-fill configuration with the diaphragm 54 generally coplanar with the outer folded portion 64 such that both the diaphragm 54 and the outer folded portion 64 provide the container 10 with a pre-fill standing surface. After the container 10 is filled, such as by hot filling, the diaphragm 54 retracts towards the first or upper end 16 such that the outer folded portion 64 solely provides the post-fill standing surface of the container 10.

FIG. 5B illustrates the base 50 in the pre-fill configuration, and is similar to the configuration of FIG. 5A, but the connecting portion 80 further includes an inset portion 90. The inset portion 90 is between the third curved portion 84 of the connecting portion 80 and the diaphragm 54. FIG. 5C illustrates the base portion 50 again in the pre-fill configuration. The pre-fill configuration illustrated in 5C is similar to that illustrated in FIG. 5A, but the outer folded portion 64 is closer to the first or upper end 16 of the container 10 as compared to the configuration of FIG. 5A. For example, the outer folded portion 64 of FIG. 5C is closer to the fifth recess or rib 36*e* as compared to the outer folded portion 64 illustrated in FIG. 5A. To compensate for the outer folded portion 64 of FIG. 5C being closer to the first or upper end 16, the vertical portion 82 of the connecting portion 80 has an increased length.

Figure 9:
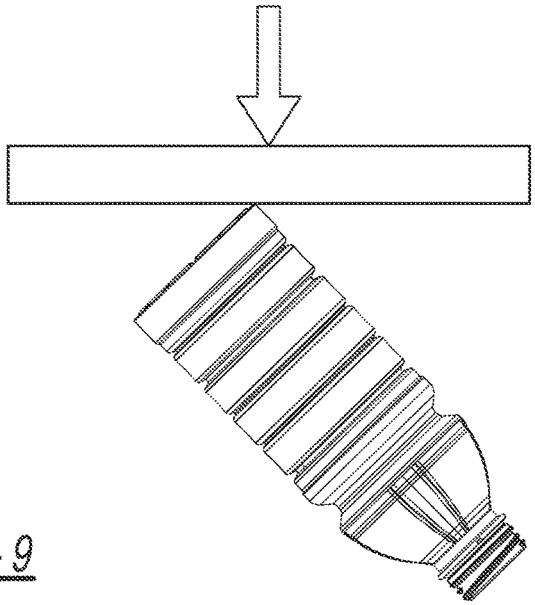
FIG. 9 illustrates a heel denting/side load force test.

FIG. 6 illustrates advantages of the container 10 according to the present teachings as compared to existing containers. For example, a heel portion of existing containers (generally located at an outer rim or wall of a base thereof) can often become deformed upon being subject to approximately 15.38 pounds of side load force at a compressive extension of about 0.250". In contrast, an exemplary container according to the present teachings was found to not experience deformation at the fold 60 (which generally replaces a heal of a conventional container) until being subject to about 21.97 pounds of side load force at a compressive extension of 0.250". FIG. 9 shows an example of the side load force test.

The fold 60 can be formed in any suitable manner. For example, the fold 60 can be formed by an overstroke of 1-10 millimeters, which is advantageously smaller than overstroke procedures for forming existing containers. Reducing the overstroke provides for increased cycle time and a more repeatable manufacturing process. For example, the fold 60 can be formed without individual cavity operator adjustment, which increases consistency of the blow molding process. Most container designs that employ overstroke have a container standing surface that resides below the active portion of the assigned vacuum absorbing base technology, which is in contrast to the container 10 in which the standing surface is within the vacuum absorbing zone.

The fold 60 also advantageously provides the base portion 50 with an increased vacuum displacement area, such as in the range of 90-95 percent of the entire base portion 50. Because the pre-fill standing surface of the base portion 50 is within the vacuum absorbing zone, any vacuum related shape change improves filled capped topload result by way of a charge-up scenario known to those skilled in the art of hot-fill package design in which fluid within the container 10 reaches an incompressible hydraulic state. This provides for self-correction of any minor sidewall imperfections experienced during fill line/warehouse handling.

The fold 60 is advantageously stronger than the sidewall 32. For example, the fold 60 is about 2-6 times stronger than the sidewall 32. The fold 60 can be included with sidewalls 32 of various thicknesses, such as 0.1-0.5 millimeters. The strength of the fold 60 is independent of the thickness of the sidewall 32. Thus the thickness of the sidewall 32 can be reduced in order to reduce the overall weight of the container 10 without sacrificing strength in the base portion 50. For example, the sidewall 32 can have a thickness of less than 0.4 millimeters, which advantageously reduces the overall weight of the container 10.

The fold 60 is located in a non-critical handling zone. Therefore, minor imperfections, such as flash, incomplete forming, or denting, will not negatively affect the height or handling of the container 10, which can reduce scrap in the manufacturing process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A blow-molded container comprising:

a finish defining an opening at a first end of the container that provides access to an internal volume defined by the container; and a base portion at a second end of the container opposite to the first end, the base portion including a fold proximate to a sidewall of the container;

wherein as blown and prior to the container being filled, a diaphragm of the base is further from the first end of the container than the folded portion;

wherein after the container is filled, the diaphragm is not further from the first end of the container than the folded portion; and wherein the diaphragm pivots about a first radius at a first curved portion of the fold, a second radius at a second curved portion of the fold, and a third radius between the diaphragm and the first radius.

2. The container of claim 1, wherein the first curved portion is closer to a longitudinal axis of the container than the second curved portion.

3. The container of claim 2, wherein the second curved portion extends to the sidewall.

4. The container of claim 2, wherein the second curved portion includes a heel of the container.

5. The container of claim 2, wherein the second curved portion provides a post-fill standing surface of the container.

6. The container of claim 1, wherein the diaphragm provides a pre-fill standing surface of the container.

7. The container of claim 1, wherein after the container is filled the diaphragm angles towards the finish between 0° and 15° at full activation.

8. The container of claim 7, wherein upon application of a top load force to the container, the angle of the diaphragm returns to 0° relative to the upper end, and the first, second, and third radii adjust to compensate for such movement of the diaphragm.

9. The container of claim 1, wherein after the container is filled the diaphragm angles towards the finish between 10° and 20° at full activation.

10. The container of claim 1, wherein the first radius and the second radius are about the same dimension and the third radius is greater than each of the first radius and the second radius.

11. The container of claim 1, wherein the third radius and the second radius both provide a post-fill standing surface of the container.

12. The container of claim 1, wherein the container further comprises a plurality of ribs defined in the sidewall of the container.

13. The container of claim 12, wherein the plurality of ribs and the base portion are configured to place the container in a state of hydraulic charge-up when top load is applied to the container after the container is filled.

14. The container of claim 13, wherein the plurality of ribs collapse upon application of top load, and movement of the base portion is constrained by a standing surface, thereby causing fluid within the internal volume of the container to reach an incompressible state to maintain the container at its same basic shape.

15. A blow-molded container comprising:

a finish defining an opening at a first end of the container that provides access to an internal volume defined by the container;

a base portion at a second end of the container opposite to the first end, the base portion includes a fold having an outer fold portion at a sidewall of the container, and an inner fold portion that is inward of the outer fold portion, the inner fold portion is closer to the first end than the outer fold portion is; and an intermediate portion of the fold between the outer fold portion and the inner fold portion, wherein the intermediate portion has a first length before the container is filled and a second length after the container is filled, the first length is shorter than the second length.

16. The blow-molded container of claim 15, further comprising a connecting portion between the inner fold portion and a diaphragm of the container, the connecting portion includes a generally vertical portion that is generally parallel to a longitudinal axis of the container and a curved portion between the generally vertical portion and the diaphragm.

17. The blow-molded container of claim 16, wherein the generally vertical portion of the connecting portion and the intermediate portion between the outer fold portion and the inner fold portion are spaced apart at a pre-fill distance prior to the container being filled, and closer together than the pre-fill distance after the container is filled.

18. The blow-molded container of claim 15, wherein the base includes a diaphragm that provides a pre-fill standing surface of the container, subsequent to the container being filled, the diaphragm is configured to move closer to the first end of the container and the outer curved portion provides a post-fill standing surface.

19. The blow-molded container of claim 15, wherein the inner fold portion includes a first curved portion and the outer fold portion includes a second curved portion, the first curved portion is closer to the first end than the second curved portion.

20. A blow-molded container comprising:

a finish defining an opening at a first end of the container that provides access to an internal volume defined by the container;

a base portion at a second end of the container opposite to the first end, the base portion including:

a fold having an inner folded portion including a first curve and an outer folded portion at a sidewall of the container including a second curve, the inner folded portion is closer to the first end of the container than the outer folded portion, the outer folded portion provides a post-fill standing surface of the container;

a diaphragm extending between the fold and an axial center of the container, the diaphragm provides a pre-filled standing surface of the container; and a connecting portion between the inner folded portion and the diaphragm including a third curve; and an inset portion between the connecting portion and the diaphragm, the inset portion extends generally perpendicular to a longitudinal axis of the container.

21. The container of claim 20, wherein both the first curve and the second curve include a pre-fill radius of curvature that is greater than a post-fill radius of curvature.

22. The container of claim 20, further comprising an intermediate portion between the inner folded portion and the outer folded portion;

wherein prior to the container being filled the connecting portion and the intermediate portion are a first distance apart, and subsequent to the container being filled the connecting portion and the intermediate portion are a second distance apart, the first distance is greater than the second distance.

23. The container of claim 20, wherein the base portion includes a standing surface within a vacuum absorbing zone.

24. The container of claim 20, wherein the fold is configured to resist side load deformation of up to about 21 lbs of force.

* * * * *